United States Patent [19]

Takahashi

[11] 4,428,095

[45] Jan. 31, 1984

[54] SAFETY DEVICE OF A HINGE

[75] Inventor: Jun Takahashi, Aikawamachi, Japan

[73] Assignee: N H K Spring Co., Ltd., Yokohama, Japan

[21] Appl. No.: 287,803

[22] Filed: Jul. 28, 1981

[30] Foreign Application Priority Data

Jul. 31, 1980 [JP] Japan ..... 55-105386

[51] Int. Cl.[3] ..... E05F 1/12

[52] U.S. Cl. ..... 16/297; 16/307; 16/308; 16/334; 16/374

[58] Field of Search ..... 16/297, 304, 305, 306, 16/307, 308, 321, 332, 334, 348, 352, 357, 374

[56] References Cited

U.S. PATENT DOCUMENTS 972,326 10/1910 Brent ..... 16/297 X 2,713,820 7/1955 Horii ..... 16/307 X 2,991,094 7/1961 Baier et al. ..... 16/332 X

*Primary Examiner*—Fred Silverberg

*Attorney, Agent, or Firm*—Fleit, Jacobson, Cohn & Price

[57] ABSTRACT

A safety device for a photocopy machine implemented by inserting a core bar rotatably into a fixed member, while the core bar rotatably supports a rotation member. A spiral spring is secured between the core bar and the rotation member, preventing the rotation of the core bar. A stopper member is placed between the core bar and the rotation member, the stopper member's position being maintained with the aid of a tension coil spring. If the spiral spring breaks, the stopper member shifts in a direction adapted to insert a projection of the stopper member into a detent on the rotation member and thereby prevent the falling of the rotation member.

1 Claim, 9 Drawing Figures

FIG.1 (b) PRIOR ART

SAFETY DEVICE OF A HINGE

BACKGROUND OF THE INVENTION

This invention relates to a safety device for a hinge employed by a rotary member such as in an office machine (especially a duplication machine) wherein a moment varies corresponding to a rotation angle.

In a lid body, especially in a device employed for opening or closing the lid of a duplication machine having a weight of several pounds, a force is necessary to prevent an accident such as catching an operator's fingers or hitting of a foot due to the falling of the lid body. It has been a problem for a long period of time, to those skilled in the art, to solve this problem.

The following hinge device is provided in order to solve this problem.

The conventional hinge device, for instance, is shown in FIGS. 1(*a*), 1(*b*) and 1(*c*). In FIG. 1, the numeral 1 is a fixed member, and a core bar 2 is secured to erected plates 1*a* and 1*b* of said fixed member with bolts 6 restraining the rotation around an axial center. A lid body 3 or its attached member (hereafter called "lid body") is supported by said core bar 2 rotatively, and between the lid body 3 and the core bar 2, a spiral spring 4 is provided. Further, numeral 5 is a belleville spring and numeral 7 is an abutment plate which serves as a washer. This hinge device is designed so that the overall characteristics of a spring torque on the spiral spring 4 and a friction force of the belleville spring 5 may be approximately equivalent to a rotational moment of the lid body 3 when the lid body 3 opens from a closing status in FIG. 1(*a*) in the direction of a'.

FIG. 7 shows this relationship. In FIG. 7, S shows a characteristic of the spring torque of the spiral spring 4, L shows the moment of the rotation of the lid body 3 and F shows the friction force of the belleville spring 5. Although the spiral spring 4 is designed so that the spring torque characteristic S may correspond to the moment of the rotation of the lid body 3, it is impossible to make it correspond through the whole range of rotation of the lid body 3. Therefore, in this hinge device, the deviation between the spiral torque characteristic S and the moment of rotation is designed so that it may be smaller than the friction force F of the belleville spring 5, and said deviation amount is adapted to be absorbed with the friction force 4. Thus, the overall characteristic of the spring torque S of the spiral spring 4 and the friction force F of the belleville spring 5 can be approximated to the moment of the rotation L, of the lid body 3, over the whole range of the lid body 3.

In the invention of the present hinge device, together with being capable of an operation force necessary for rotation of the lid 3*a*, the lid body may be stopped at an arbitrary position within a range of operation.

In the prior art hinge device, however, when the spiral spring 4 is broken, the lid body 3 openings upwards, falls down rapidly, thereby causing an accident such as catching an operator's fingers or the like.

SUMMARY OF THE INVENTION

The object of this invention is to prevent the sudden falling down of the lid body even if there is no support to the lid body caused by the breakdown of the spiral spring.

DETAILED DESCRIPTION OF THE INVENTION

The embodiment of the invention will hereinafter be described with reference to the attached drawings.

Figure 1A:
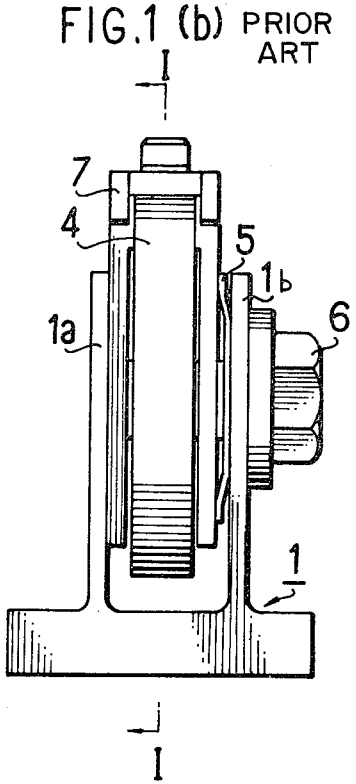
FIG.1(a) PRIOR ART
FIG. 1*a* is a side view of a hinge closing mechanism with a' indicating the direction of movement.
Figure 1A:
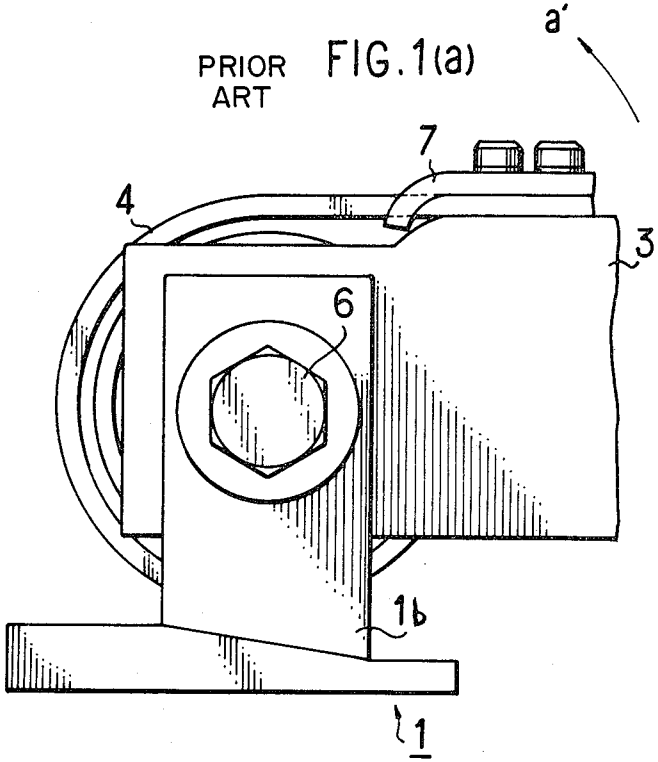
FIG.1(a) PRIOR ART
Figure 1:
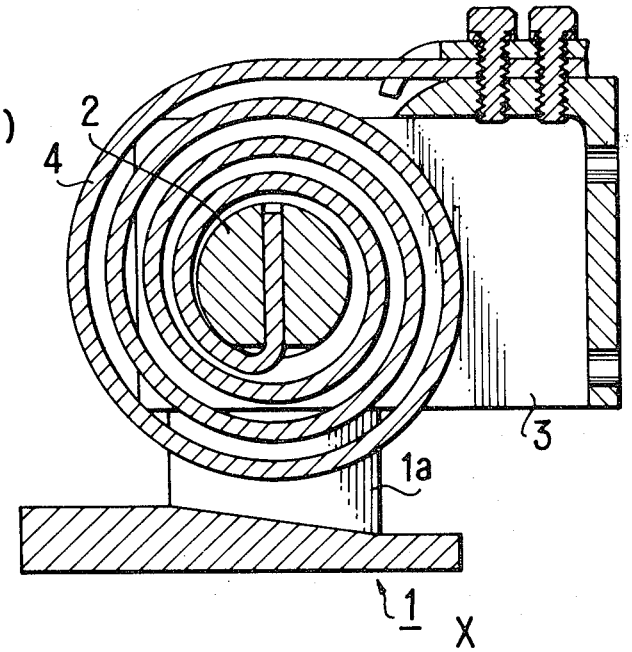
FIG.1 (c) PRIOR ART
FIG. 1*b* is a rear view of a hinge closing mechanism.
FIG. 1*c* is a sectional view along the lines I—I of FIG. 1*b*.
Figure 2:
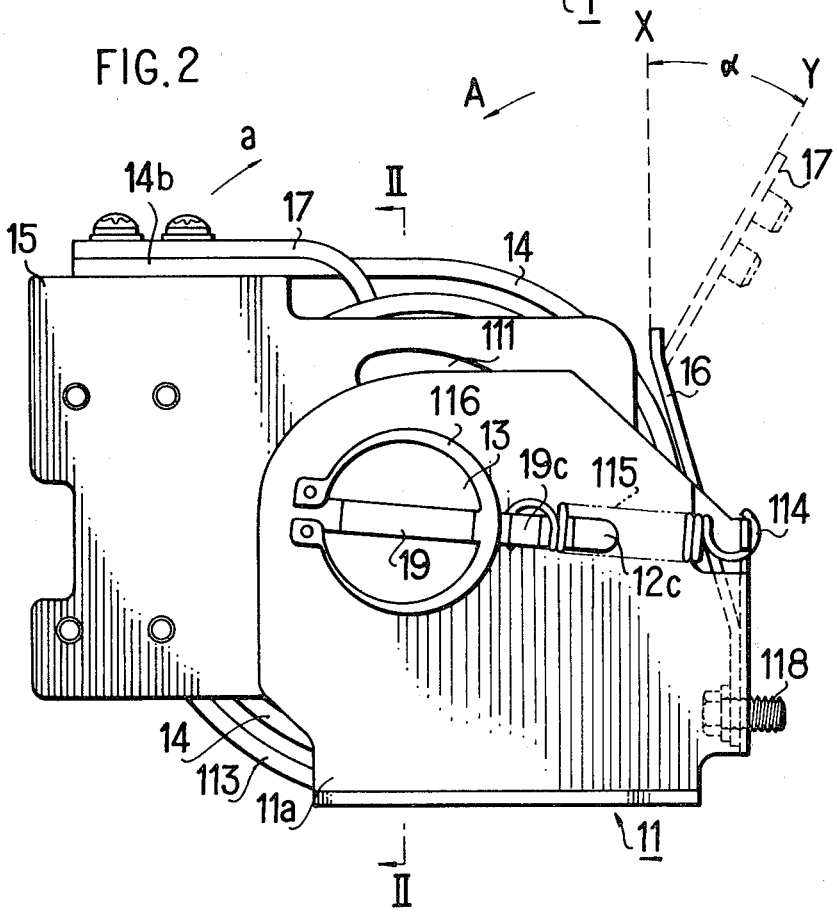
FIG. 2 is an enlarged view of the hinge device secured by a safety device in accordance with this invention.
Figure 3:
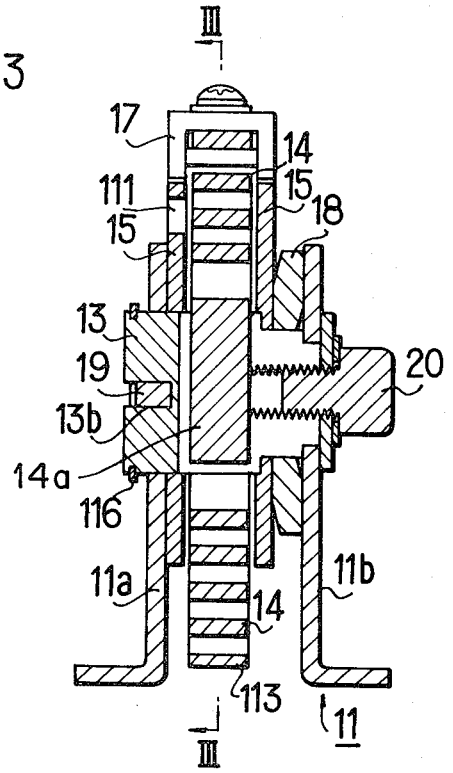
FIG. 3 is a section view along the line II—II of FIG. 2.
Figure 4:
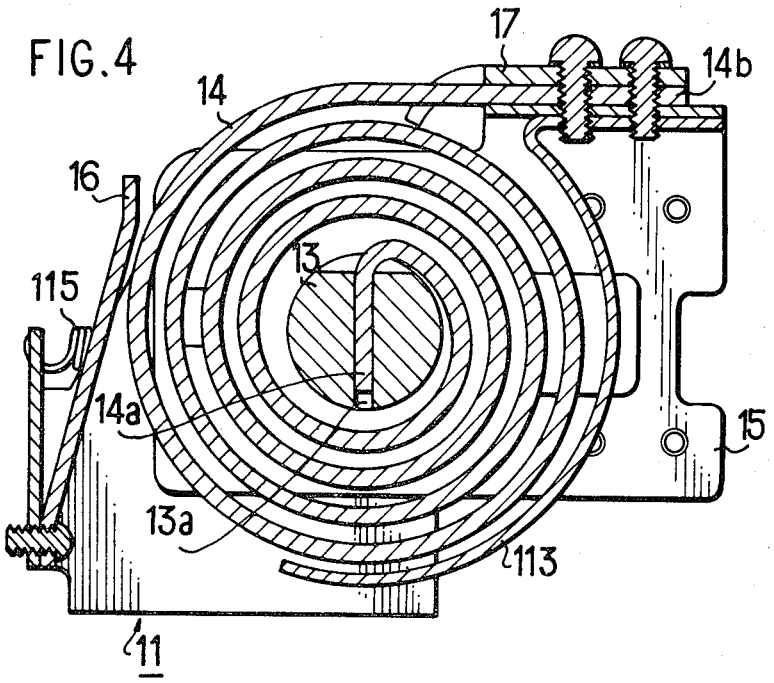
FIG. 4 is a sectional view along the line III—III of FIG. 3.

In FIG. 2 through FIG. 4, the numeral 11 is a fixed member, said fixed member being provided with plates 11*a* and 11*b* integrally thereto. The member 13 is a core bar fixedly fastened to said plates 11*a* and 11*b* by a bolt 20. Reference numeral 15 is a lid body rotatably supported by the core bar 13. Said lid body 15, in an opening operation, being moved from a horizontal point until reaching a vertical point at point X in FIG. 2. Reference numeral 14 is a spiral spring fixed at an outer end 14*b* to the lid body 15 and its inner end 14*a*, is secured to a groove 13*a* of the core bar 13.

The lid body 15 is secured to the outer end 14*b* of the spiral spring 14. The position of the lid body 15, when the spiral spring 14 is in an untensioned postion, is at point Y in FIG. 2. At this position, a preset force $\alpha$ is provided to the core bar 13 and the lid body 15 at the opening terminal point of the lid. Reference numeral 16 is a sheet spring attached to the fixed member 11 so that it may abut a plate 17 which serves as a washer, fixed to the lid body 15 in the vicinity of the closing terminal point, point X, of the lid body 15.

Further, the reference numeral 18 is a belleville spring for providing a proper friction force to the rotation of the lid body 15, and the reference numeral 113 is a cover of the spiral spring 14. Furthermore, 19 is a stopper member, by which the core bar 13 is restrained from rotating against the fixed member 11. The stopper member 19 is energized and maintained by a tension coil spring 115 with a projection 19*c*. A projection 114 is secured to a fixed member 11.

Figure 5:
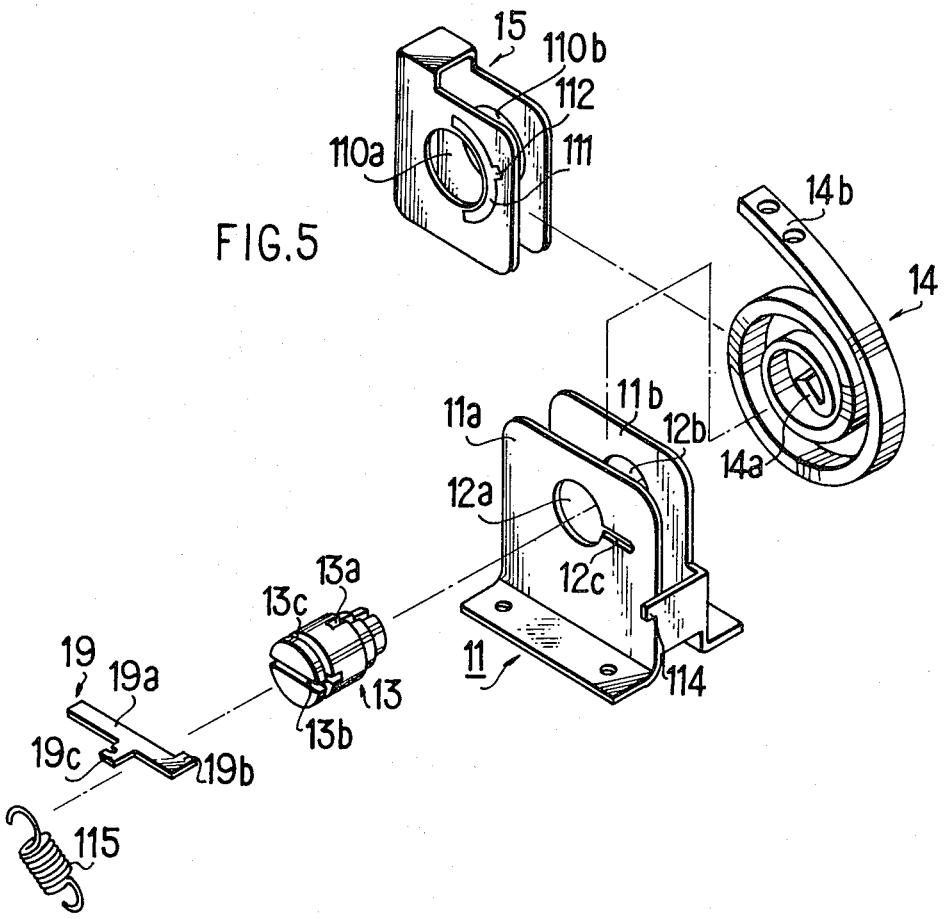
FIG. 5 is an exploded view of the hinge device provided with the safety device of this invention.

A securing method for the stopper member 19 is described with reference to FIG. 5.

At the end of the lid body 15, there are perforated holes 110*a* and 110*b* for the core bar 13. In plates 11*a* and 11*b* of the fixed member 11, are perforated holes 12*a* and 12*b* for core bare 13, corresponding to perforated holes 110*a* and 110*b*. A long groove 111 is located along the holes 110*a* in lid body 15, the long groove being provided with a detent 112. In the perforated hole 12*a*, a cutting groove 12*c*, is opened to the perforated hole.

Split grooves 13*a* and 13*b* are formed at the ends of core bar 13 and a circumference groove 13*c* is formed around the outer circumference thereof.

The stopper member 19 is formed to be approximately L-shaped, having a side 19*a* and another side 19*b*, said side 19*a* being provided with projection 19*c*.

The lid 15, spiral spring 14 and the core bar 13 are assembled as described above. The side 19*a* of the stopper member 19 after assembling, is inserted into both of the split groove 13*b* and the cutting groove 12*c* of the fixed member 11. Another side 19*b* is losely inserted into the long groove 111 of the lid body 15.

In this position, the core bar 13 is energized to rotate in a direction with the aid of a preset force $\alpha$ by the spring 14 at point X. This energized rotation is gradually increased since the spiral spring 14 is wound according to a gradual closing of the lid body 15 from point X. The stopper member 19 is frictionally engaged with the side walls of the split groove 13*b* of the core bar and the cutting groove 12*c* of the fixed member 11. A large friction force operates against stopper 19 sliding inside the split groove 13*b* and the cutting groove 12*c*.

Reference numeral 115 is a tension coil spring, as shown in FIG. 2, tensionally secured to the projection 19*c* of the stopper member 19, and the projection 114 set on the fixed member 11. This energizes the stopper member 19 toward an inner direction of the cutting groove 12*c* of the fixed member 11. The energized force of the tension coil spring 115 is designed to be smaller than the friction force operated upon the stopper member 19, so that the stopper member 19 may be not shifted by the energized force of the tension coil spring 115.

In FIG. 2, the numeral 116 is a C shape retaining ring, said C shape retaining ring 116 being inserted into the circumference groove 13*c* (see FIG. 5) of the core bar 13 after the insertion of the stopper member 19.

The safety device is constructed by securing the stopper member 19 as described above. The action of the safety device will be described as follows.

Since the side 19*b* of the stopper 19 in the safety device travels within the long groove 111, perforated into the lid body 15, there exists no resistance upon the operation of the opening and closing of the lid body.

By this safety device, when the support to the lid body 15 is lost by the breakdown of the spiral spring 14, the lid body 15 near the opening terminal point drops down rapidly in the direction A of FIG. 2 and loses the friction force acting on the stopper member 19. Breaking of spring 14 releases the tension on stopper 19 which now is acted upon by spring 115. The stopper member 19 shifts toward an inner direction along the groove 12*c* of the fixed member 11 with the aid of the energized force of the tension coil spring 115, and the top end of the side 19*b* of the stopper member 19 is inserted into the detent 112 of the long groove 111 of the tilted lid body 15. The falling of the lid body 15 is stopped by this insertion.

Figure 6:
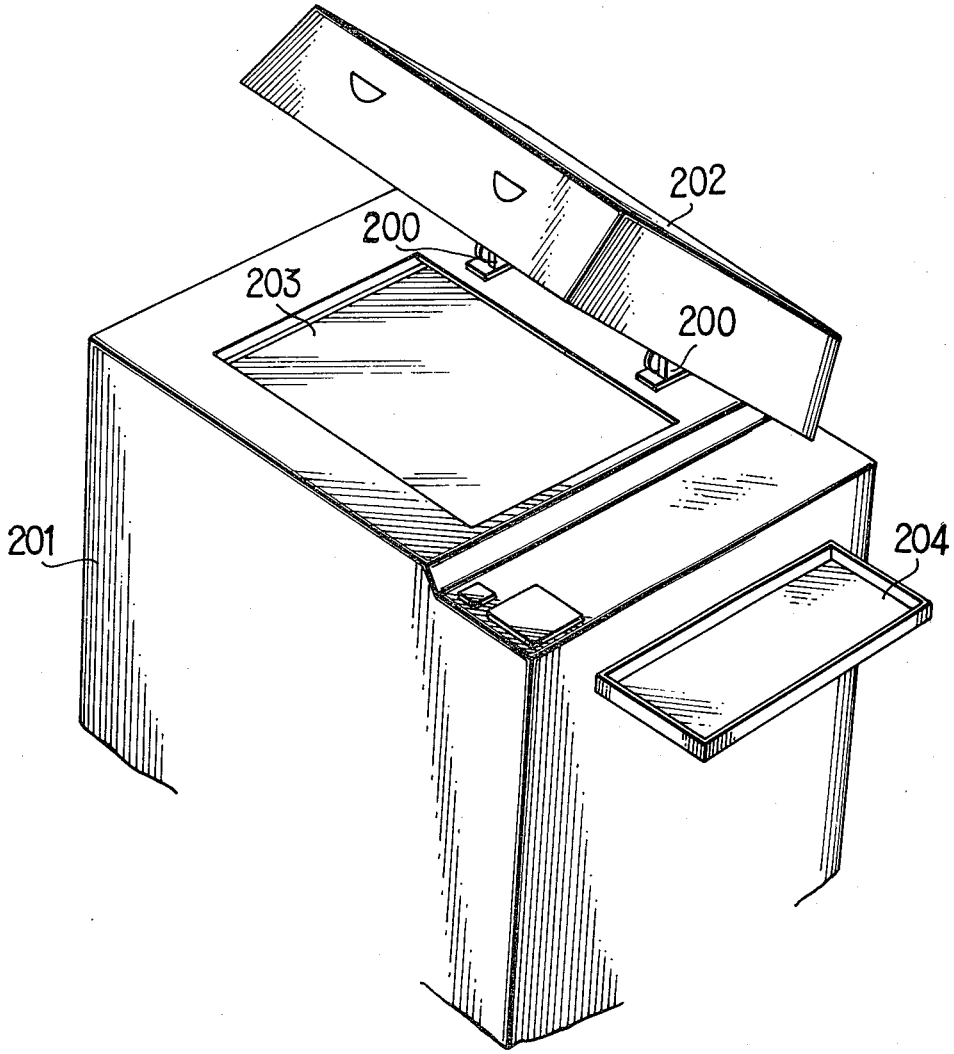
FIG. 6 is a perspective view of the hinge device provided with the safety device of this invention, installed on a machine lid.
Figure 7:
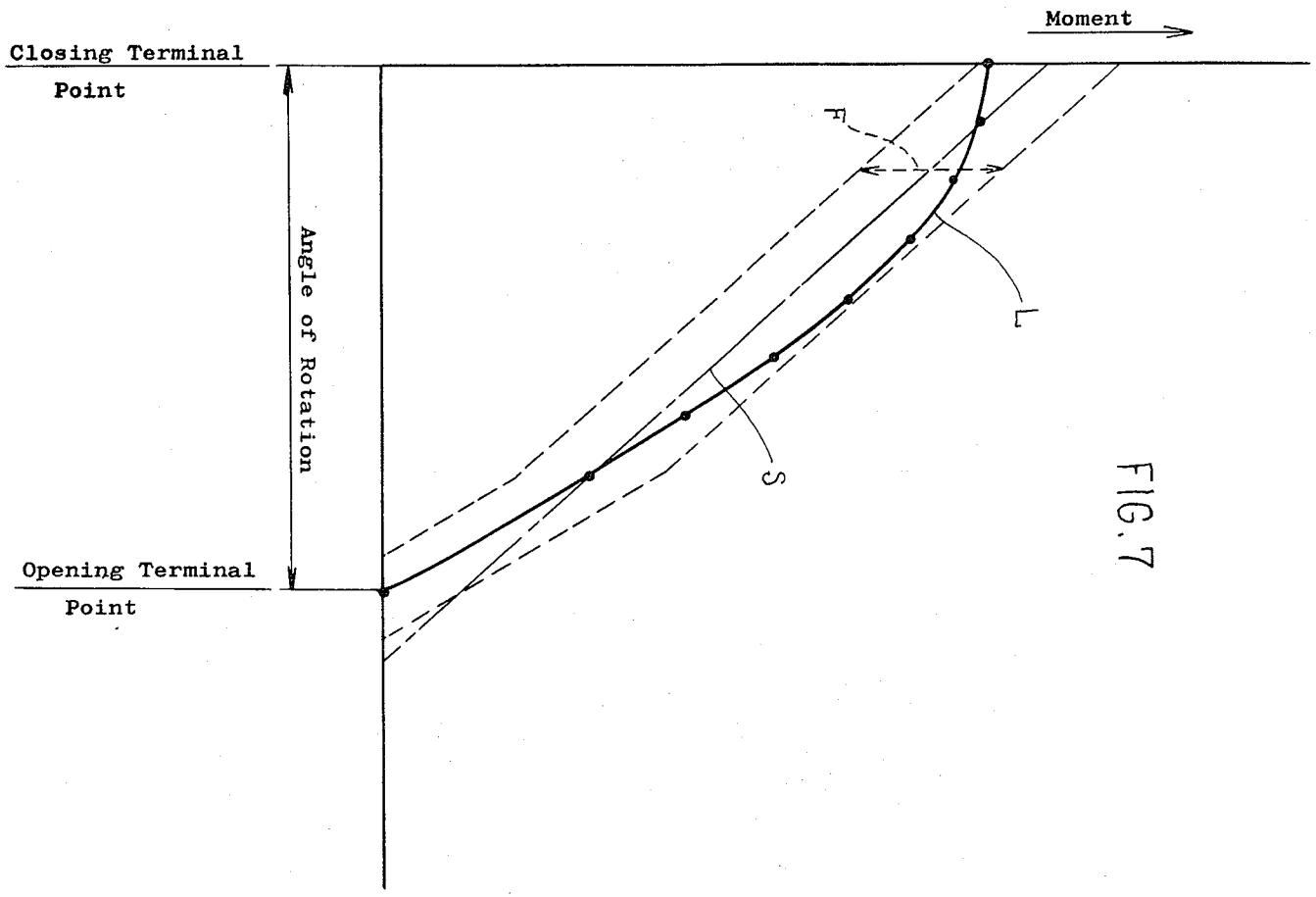
FIG. 7 is a graph showing the characteristics of the moment (torque) to the angle of the rotation of the lid body in a conventional hinge device.

An example of the hinge provided with the safety device employed for the lid of a duplication machine, is shown in FIG. 6. In FIG. 6, reference numeral 201 is a main body of the duplication machine, the main body 201 being provided with the lid body 202 which opens and closes while supported at its one end on the upper surface. The hinge device 200 is secured to the supporting position of the lid body 202. Further, reference numeral 203 is a glass plate and reference numeral 204 is a delivery tray.

The safety device, in accordance with this invention, has the construction and function described above, wherein it is possible to properly prevent the falling of the lid body, even if the breakdown of the spiral spring occurs, thereby being capable of preventing an injury to the operator.

I claim:

1. A hinge device comprising:

a rotatably moveable rotation member supported by a core bar;

a spiral spring with an inner and an outer end connected to said rotation member;

a safety device, said safety device comprising a first split groove on an outer end of said core bar;

a second split groove on an end of said core bar, opposite to that of said first split groove;

said inner end of said spiral spring is located within said second split groove;

a first groove having a detent, said first groove being provided in and located near a perforated hole in said rotation member, a second groove being provided in and which opens to a perforated hole in a fixed member;

said core bar passing through the perforated holes;

an L-shaped stopper member slidingly engaged in said first split groove of said core bar, said first groove of said rotation member and said second groove of said fixed member;

a tension coil spring attached to a first projection on said stopper member and attached to said fixed member, said coil spring having a weaker spring force than said spiral spring; and a second projection on said stopper member slidingly engaged in said first groove of said rotation member, whereby the tensioning force of the tension coil spring is activated upon malfunction of the spiral spring in order to pull said second projection on said stopper member into said detent of said first groove of said rotation member, preventing further rotation of said rotation member.

* * * * *